US006004007A

United States Patent [19]

Weigert

[11] Patent Number: 6,004,007

[45] Date of Patent: Dec. 21, 1999

[54] SPOTLIGHT WITH AN ADJUSTABLE ANGLE OF RADIATION

[75] Inventor: Dedo Arndt Weigert, Munich, Germany

[73] Assignee: Dedo Weigert Film GmbH, Munich, Germany

[21] Appl. No.: 08/985,192

[22] Filed: Dec. 4, 1997

[51] Int. Cl.[6] ..... F21V 17/00

[52] U.S. Cl. ..... 362/268; 362/270; 362/296; 362/306; 362/285; 362/319

[58] Field of Search ..... 362/268, 270, 362/277, 296, 306, 284, 285, 286, 319

[56] References Cited

U.S. PATENT DOCUMENTS

| | | | |
|---|---|---|---|
| 2,177,639 | 10/1939 | Erickson . | |
| 4,823,243 | 4/1989 | Weigert | 362/281 |
| 5,083,253 | 1/1992 | Hahnel | 362/306 |
| 5,408,398 | 4/1995 | Chang | 362/293 |
| 5,461,554 | 10/1995 | Leonetti et al. | 362/390 |

FOREIGN PATENT DOCUMENTS 2 037 415 7/1980 United Kingdom .

*Primary Examiner*—Sandra O'Shea
*Assistant Examiner*—John A. Ward
*Attorney, Agent, or Firm*—Griffin, Butler Whisenhunt & Szipl, LLP

[57] ABSTRACT

A spotlight with an adjustable angle of radiation has a light source (4) and a reflector (5) associated with the light source (4). A first focusing lens (2) is positioned in a beam path of the light source-reflector combination (4, 5). A second focusing lens (6) is placed in the beam path between the light source (4) and the first focusing lens (2). The reflector (5), the light source (4), and the second focusing lens (6) are mounted as an optical unit that is movable relative to the first focusing lens (2), along an optical axis of the spotlight along which the beam path extends. Inside the optical unit, a distance between the light source (4) and the second focusing lens (6) is adjustable. In addition, inside the optical unit a distance between the light source (4) and the reflector (5) is adjustable.

4 Claims, 10 Drawing Sheets

SPOTLIGHT WITH AN ADJUSTABLE ANGLE OF RADIATION

BACKGROUND OF INVENTION

This invention relates to a spotlight with an adjustable angle of radiation, or reflection, having a light source, a reflector associated with the light source, a first focusing lens (collector or converging lens) placed in a direction of beam (along a beam path) of the light source-reflector combination, and a second focusing lens placed in the beam path between the light source and the first focusing lens, whereby the reflector, the light source, and the second focusing lens are mounted as an optical unit that is movable relative to the first focusing lens along an optical axis of the spotlight, and a distance between the light source and the second focusing lens is adjustable inside the optical unit.

Spotlights with adjustable angles of radiation have been known in the prior art for a long time. These spotlights can be divided into two basic classes, namely Fresnel (stepped) lens spotlights and spotlights having very deep reflectors.

Conventional Fresnel lens spotlights each have a single echelon lens (Fresnel lens). Incandescent bulbs, halogen bulbs, or discharge lamps are used as light sources in these echelon spotlights. In such a spotlight, the light source and a reflector are mounted on a slide at a fixed distance from each other. The slide can be moved relative to the Fresnel lens. Focusing is achieved by moving the slide. However, in Fresnel lens spotlights of this type, a significant effective loss of light occurs at focus settings with small angles of reflection. Since there is no second lens to concentrate the light toward the Fresnel lens, a large portion of the light emitted by the light source is simply absorbed by an inner wall of a housing at such focus settings, which results in loss of light and unneeded heating of the housing.

In general, a spotlight with a very deep reflector is constructed so that a lamp and a reflector can be displaced relative to each other, but in these spotlights the lamp remains inside the reflector, along its optical axis, at all times. By changing a position of the lamp within the reflector, the angle of radiation of these spotlights is modified. However, a focusing path that can be achieved in this way is minimal, so that an angle of radiation can be varied only within relatively narrow limits. Spotlights of this type do provide a high degree of light efficiency, but they exhibit unfavorable light distribution in nearly all lamp positions. A reason for this generally poor light distribution is that a reflector shape provided respectively for each of these spotlights, in terms of the resulting light distribution, can be optimally designed for only a single lamp position. Uneven light distribution occurs when the lamp or the reflector are moved for focusing purposes. Therefore, to improve light distribution, replaceable front lenses are often used in spotlights of this type. These lenses may have frosted properties, a honeycomb structure, or other special design features that serve to provide additional focusing or dispersion of the light. With these spotlights, therefore, variously modified front lenses must be used for various focus settings. For many such spotlights with a very deep reflector, in fact, both the lamp and the reflector are mounted in a fixed position in a housing, i.e. the angle of radiation is modified in such cases exclusively by changing front lenses that differ in design. This entails a relatively significant amount of labor and time spent in changing the front lenses, if a spotlight of this type is used in a situation in which the focus setting must be changed often.

A spotlight with an adjustable angle of radiation that already exhibits a significant improvement over the spotlights described above is disclosed by U.S. Pat. No. 4,823,243. This spotlight has a light source, a reflector associated with the light source, a first focusing lens placed in a beam path in a direction of beam of the light source-reflector combination, and a second focusing lens located between the light source and the first focusing lens. The reflector, the light source, and the second focusing lens are mounted as an optical unit that is movable relative to the first focusing lens along the optical axis of the spotlight. Inside the optical unit, a distance between the light source and the second focusing lens is adjustable. The spotlight disclosed in U.S. Pat. No. 4,823,243 provides a large focus area (see FIG. 4 herein), and achieves a high degree of light efficiency in terms of energy required to operate the spotlight. In addition, the spotlight disclosed in U.S. Pat. No. 4,823,243 provides light distribution that is so even that a traditional concept of "bean and spread" or "conical and diffused light" can no longer be applied. As shown in FIG. 4, a characteristic illuminance (illumination intensity) curve of a lighted field does exhibit a slight shoulder, but light intensity across an entire lighted area is largely constant.

It is an object of this invention to provide a spotlight with an adjustable angle of radiation that allows even greater variability in an angle of radiation and in illuminance than do known spotlights with adjustable angles of radiation.

SUMMARY

According to principles of this invention, in a spotlight with an adjustable angle of radiation having a light source, a reflector associated with the light source, a first focusing (collector) lens placed in a beam direction of the light source-reflector combination along a beam path, and a second focusing lens placed in the beam path between the light source and the first focusing lens, with the reflector, the light source, and the second focusing lens being mounted as an optical unit that is movable relative to the first focusing lens along an optical axis of the spotlight, a distance between the light source and the second focusing lens is adjustable inside the optical unit, and a distance between the light source and the reflector is adjustable inside the optical unit.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Each of FIGS. 1*a* through 1*e* shows a schematic cross-sectional view of a spotlight of this invention, with an optical unit—comprising a light source, a reflector, and a second focusing lens—being in different positions ranging from as close as possible to a first focusing lens, to a position as distant as possible from the first focusing lens;

Figure 5:
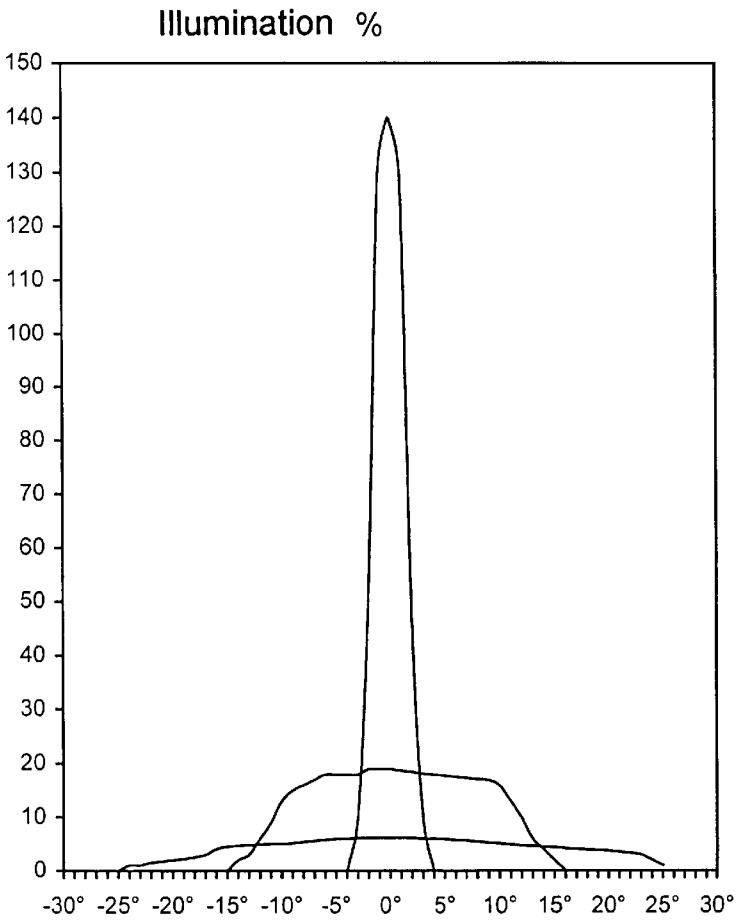
Figure 4:
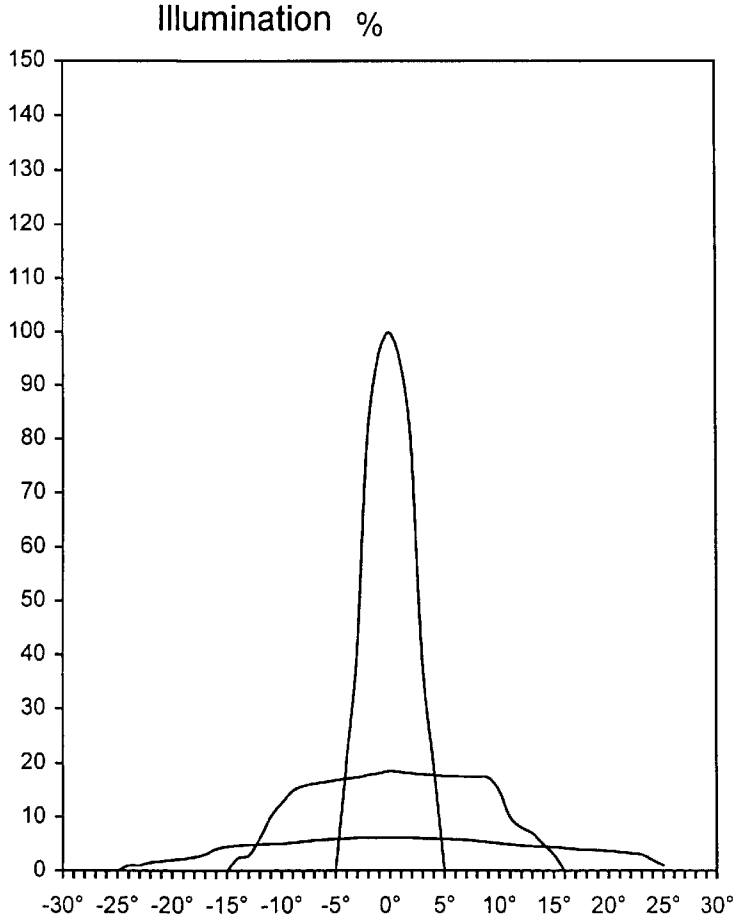
Fig. 4 (PRIOR ART)

Each of FIGS. 2*a* through 2*e* shows a schematic cross-section of a further embodiment of a spotlight of this invention, with an optical unit—comprising a light source, a reflector, and a second focusing lens—being in different positions ranging from as close as possible to a first focusing lens, to a position as distant as possible from the first focusing lens;

Each of FIGS. 3*a* through 3*f* shows a schematic cross-sectional view of a third-embodiment spotlight of this invention, with an optical unit—comprising a light source, a reflector, and a second focusing lens—being in different positions ranging from as close as possible to a first focusing lens, to a position as distant as possible from the first focusing lens;

FIG. 4 is a graphic plot of light distribution curves of a spotlight disclosed in U.S. Pat. No. 4,823,243, at various focus settings; and FIG. 5 is a graphic plot of light distribution curves of a spotlight pursuant to this invention, at various focus settings.

DESCRIPTION OF THE PREFERRED EMBODIMENT

Figure 1A:
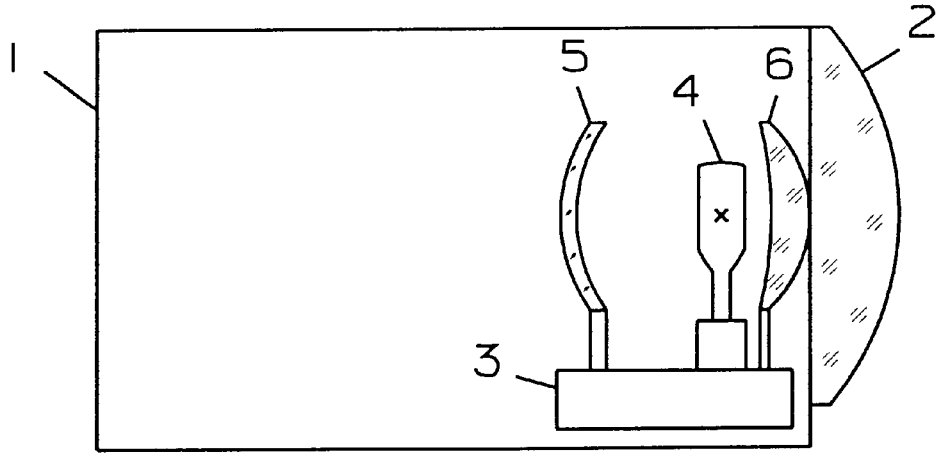

A cross-sectional view of a spotlight of this invention is shown in FIG. 1*a* . The spotlight has a can-shaped, opaque, housing 1, in which a first focusing (collecting or converging) lens 2 is positioned at a light-exiting end. Inside the housing 1, a light source 4, comprising an incandescent filament bulb with a small filament, and a reflector 5 associated with the light source 4, are mounted on a slide 3. The light source 4 and the reflector 5 are mounted so that a resulting beam path is directed toward the first focusing lens 2. Furthermore, a second focusing (collecting or converging) lens 6 is positioned on the slide 3 in the beam path between the light source 4 and the first focusing lens 2. In the illustrated embodiment of the spotlight pursuant to this invention, the second focusing lens 6 is a meniscus lens with a crystalline etched concave surface, the convex surface of which is directed toward the first focusing lens 2.

In this embodiment, the light source 4, the reflector 5, and the second focusing lens 6 are mounted so that both a distance between the light source 4 and the second focusing lens 6 and a distance between the light source 4 and the reflector 5 can be changed.

It is further possible to apply graining to both the first focusing lens 2 and the second focusing lens 6, respectively, in order to produce a micro-lens structure. Highly uniform light distribution is achieved in this manner.

FIG. 1*a* shows the light source 4, the reflector 5, and the second focusing lens 6 in a position of maximum angle of radiation of the spotlight of this invention. A distance between the first focusing lens 2 and the second focusing lens 6, and a distance between the second focusing lens 6 and the light source 4 are minimal, relative to dimensions of the spotlight, and a distance between the light source 4 and the reflector 5 is a maximum distance as determined by structural mounting conditions.

Figure 1B:
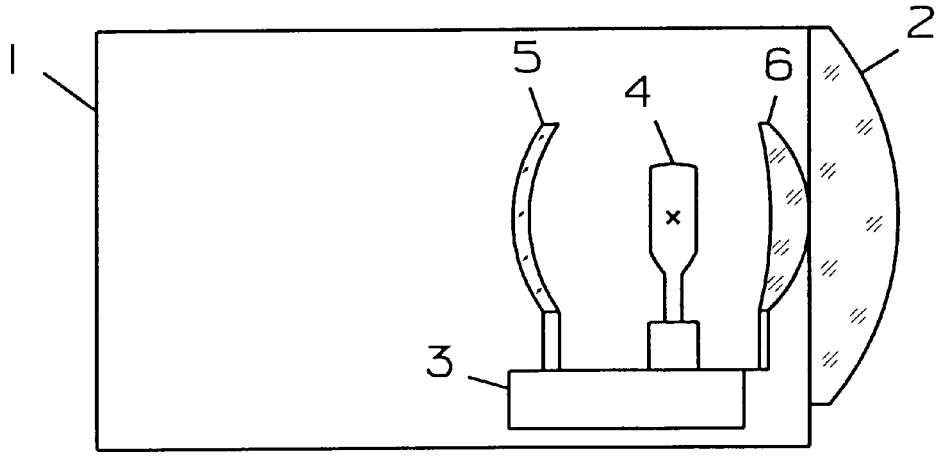

In order to reduce an angle of radiation, the slide 3 is moved away from the first focusing lens 2. A mechanism of the slide and of guide parts that work in combination with it is designed so that the second focusing lens 6 initially remains in its original position, and only the light source 4 and the reflector 5 move away from the first focusing lens 2, while retaining the original distance separating them from each other. This type of movement continues until a distance between the light source 4 and the second focusing lens 6 reaches a predetermined value. FIG. 1*b* shows the optical system of the spotlight of this invention in this specific configuration.

Figure 1C:
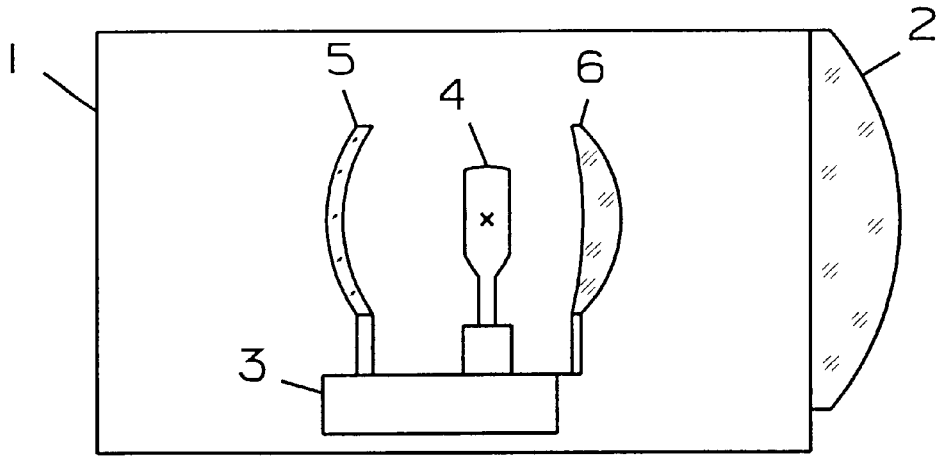

When the slide 3 is moved even further away from the first focusing lens 2, as shown in FIG. 1*c*, initially there is no change in a distance separating the light source 4 and the reflector 5 or in a distance established between the light source 4 and the second focusing lens 6. The further the light source 4, the reflector 5, and the second focusing lens 6 move away from the first focusing lens 2, the smaller the angle of radiation becomes, and the greater is an illuminance in an illuminated field.

Figure 1D:
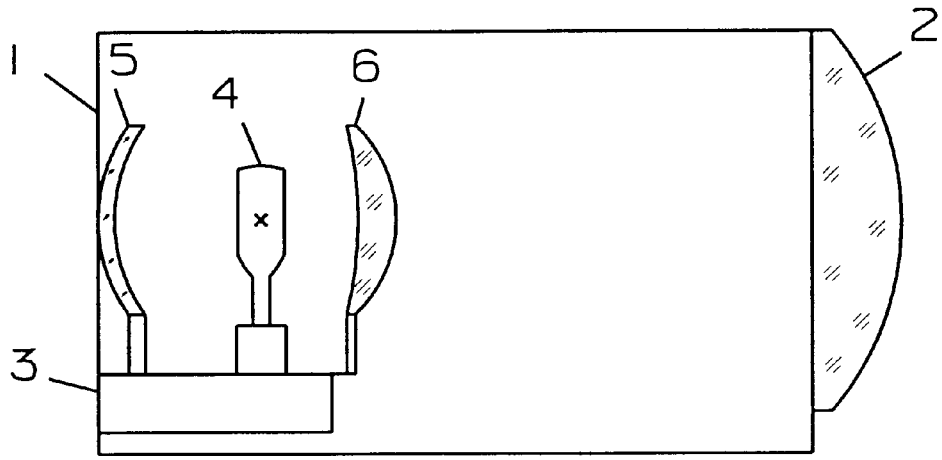

Finally, the reflector 5 reaches a position of maximum separation from the first focusing lens 2, as determined by dimensions of the spotlight, and stops moving (see FIG. 1*d*). This is the position at which the spotlight disclosed in U.S. Pat. No. 4,823,423 achieves its minimum angle of radiation and its maximum illuminance.

In the embodiment of the spotlight of this invention illustrated in FIGS. 1*a*–1*e*, however, it is possible to advance the light source 4 and the second focusing lens 6, while maintaining their established relative spacing from one another, even further away from the first focusing lens 2 (and thereby closer to the reflector 5 (see FIG. 1*e*), while the reflector 5 remains stationary.

A further embodiment of the spotlight of this invention is depicted in FIGS. 2*a*–2*e*. This second embodiment of the spotlight of this invention is substantially like that depicted in FIGS. 1*a*–1*e*. The one difference is that, in the embodiment of FIGS. 2*a*–2*e*, when the reflector 5 has reached its distant-most position from the first focusing lens 2, as allowed by dimensions of the spotlight, the second focusing lens 6 can also not be moved further from the first focusing lens 2. In this case, only the light source 4 can be moved further toward the reflector 5 while the relative maximum spacing between the second focusing lens 6 and the reflector 5 remains constant once the reflector 5 and the second focusing lens 6 have reached their furthest-most spacing from the first focusing lens (see FIG. 2*e*).

In this manner, the angle of radiation of the spotlight of this invention is reduced even further. However, it is particularly surprising for experts that this produces an increase of the illuminance in an illuminated field that is disproportionately great in relation to the reduction in the angle of radiation. Even when the angle of radiation is reduced by just a few percent in this described manner, an increase in light yield, or output, of up to 32 percent is achieved, depending on the size of the light source. This means that, with aid of the spotlight of this invention, a loss of light during focusing in the narrow-angle range is reduced to an extraordinarily great degree.

FIGS. 4 and 5 illustrate light distribution curves of the known spotlight disclosed in U.S. Pat. No. 4,823,234 (FIG. 4) and those of the FIGS. 2*a*–2*e* embodiment of this invention (FIG. 5), respectively. It should be noted that the spotlight of this invention has a somewhat broader range of angles of radiation, and provides a surprising greater variability in illuminance, particularly in the narrow-angle reflection range.

| Spotlight Type | Spotlight of this invention | ARRI-Junior 300 plus | ARRI-Junior 650 plus | ARRI-Junior 1000 | ARRI-Kompakt 200 W |
|---|---|---|---|---|---|
| Minimum angle of radiation $\alpha_{min}$ | 7.5° | 15° | 12° | 12° | 9° |
| Maximum angle of radiation $\alpha_{max}$ | 52° | 57° | 55° | 60° | 50° |
| Angle ratio $\alpha_{min}:\alpha_{max}$ | 6.9 | 3.8 | 4.6 | 5.0 | 5.6 |
| Illuminance at maximum angle of radiation $I_{min}$ at a distance of 3 meters from the | 950 | 580 | 1,450 | 1,900 | 1,120 |

-continued

| Spotlight Type | Spotlight of this invention | ARRI-Junior 300 plus | ARRI-Junior 650 plus | ARRI-Junior 1000 | ARRI-Kompakt 200 W |
|---|---|---|---|---|---|
| spotlight (relative units) | | | | | |
| Illuminance at minimum angle of radiation $I_{max}$ at a distance of 3 meters from the spotlight (relative units) | 12,100 | 1,800 | 7,000 | 9,500 | 7,500 |
| Focus ratio $I_{max}$:$I_{min}$ | 12.7 | 3.1 | 4.8 | 5.0 | 6.7 |
| Focus ratio/Angle ratio | 1.84 | 0.82 | 1.04 | 1.00 | 1.19 |

Characteristic data of the described embodiment of the spotlight of this invention are presented in the preceding table, in comparison with corresponding data for state of art spotlights from the ARRI company.

While the focus ratio: angle ratio parameter for spotlights from the state of art is close to 1, the same parameter has a value of almost 2 for the spotlight of this invention. In the spotlight of this invention, even the absolute focus ratio is two to four times greater than for the spotlights of the known art.

Figure 1E:
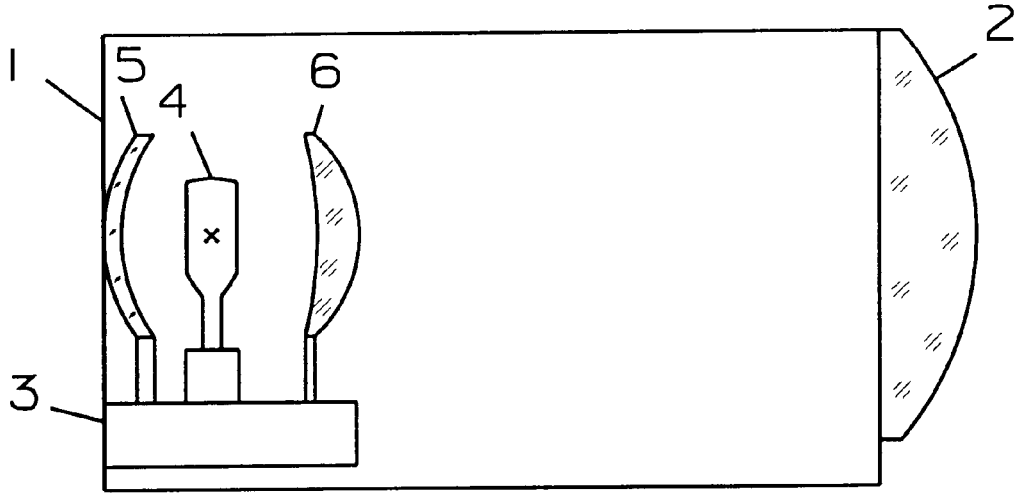
Figure 2A:
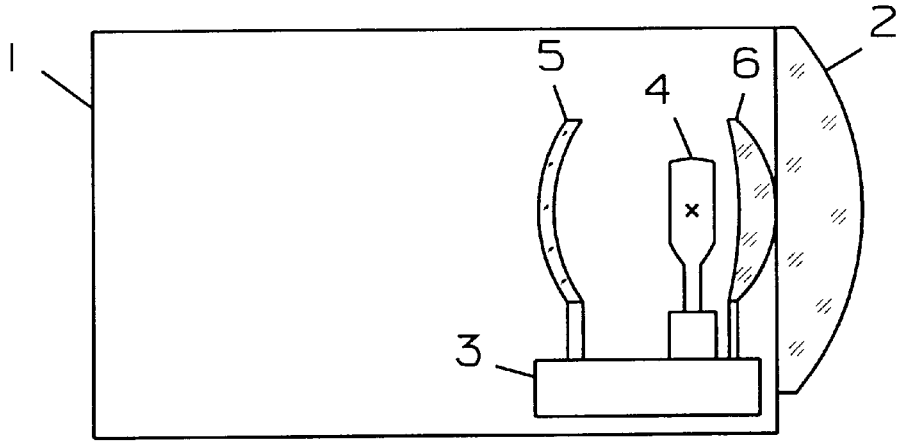
Figure 2B:
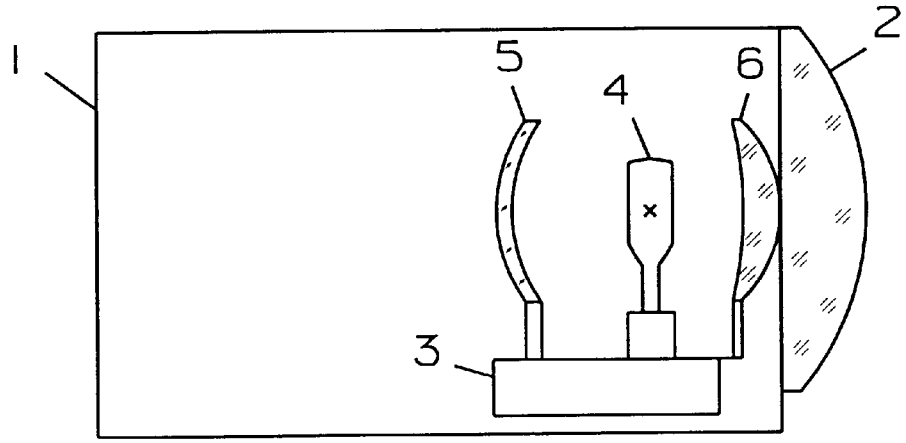
Figure 2C:
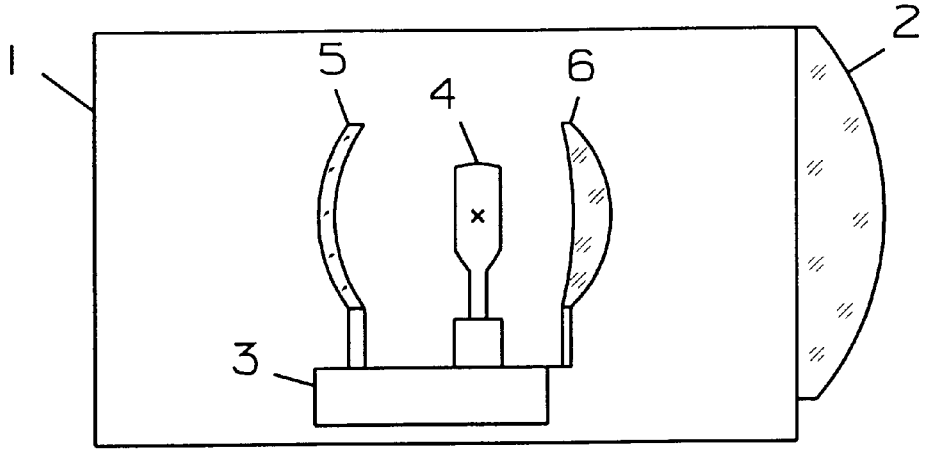
Figure 2D:
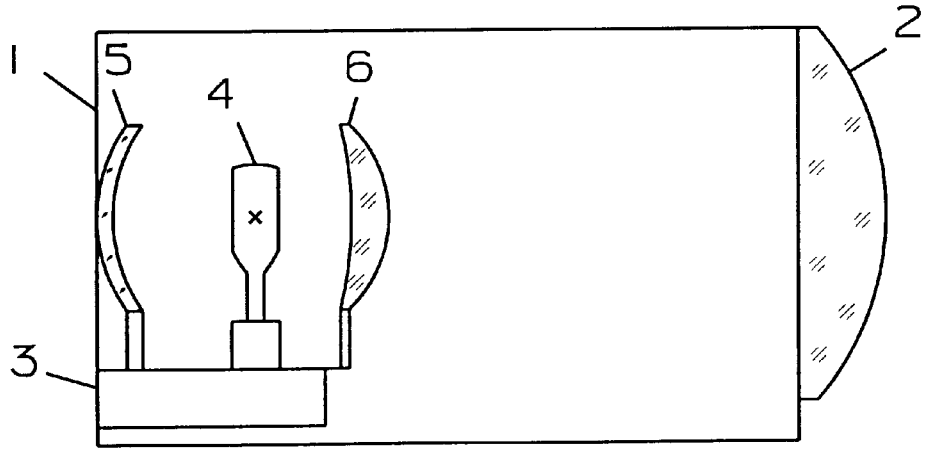
Figure 2E:
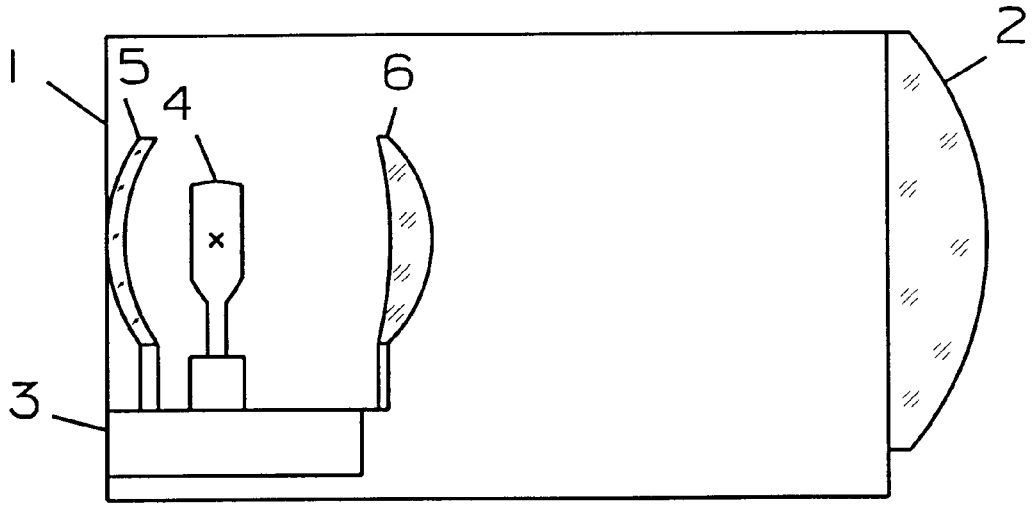

In the illustrated embodiments of the spotlight of this invention, a reverse movement of the light source 4, the reflector 5, and the second focusing lens 6 toward the first focusing lens 2, in contrast to the direction of movement described above, takes place in exactly a reverse sequence, starting from the position shown in FIG. 1*e*/2*e*, and stepping through the positions illustrated in FIGS. 1*d*/2*d*, 1*c*/2*c*, and 1*b*/2*b*, until the position shown in FIG. 1*a*/2*a* is reached. Initially, for the embodiment of FIGS. 1*a*–1*e* of the spotlight of this invention, only the light source 4 and the second focusing lens 6 move (while maintaining the distance that separates them from each other) away from the stationary reflector 5 toward the first focusing lens 2 (FIG. 1*d*). In the embodiment of the spotlight described with reference to FIGS. 2*a* through 2*e*, at first, only the light source 4moves away from the stationary reflector 5 in the direction of the likewise stationary second focusing lens 6, and thereby in the direction of the first focusing lens 2 (FIG. 2*d*). When the predetermined maximum distance between the light source 4 and the reflector 5 is reached, the light source 4, the reflector 5, and the second focusing lens 6 move along with the slide 3 toward the first focusing lens 2 (FIG. 1*c*/2*c*), while maintaining distances that separate them from each other, and this is true for both above-described embodiments of a spotlight of this invention. Finally, the second focusing lens 6 reaches its minimum distance from the first focusing lens 2 (FIG. 1*b*/2*b*), and the light source 4 and the reflector 5 are moved a little further toward the second focusing lens 6 (FIG. 1*a*/2*a*), until a predetermined maximum angle of radiation is ultimately achieved.

A mechanical design of the slide 3 and of guide parts that operate in combination with it requires no further detailed description, since experts are familiar with a number of different possibilities for fabricating a mechanical slide system that make possible the range of movements described above, with reference to FIGS. 1*a* through 1*e* and 2*a* through 2*e*.

Figure 3A:
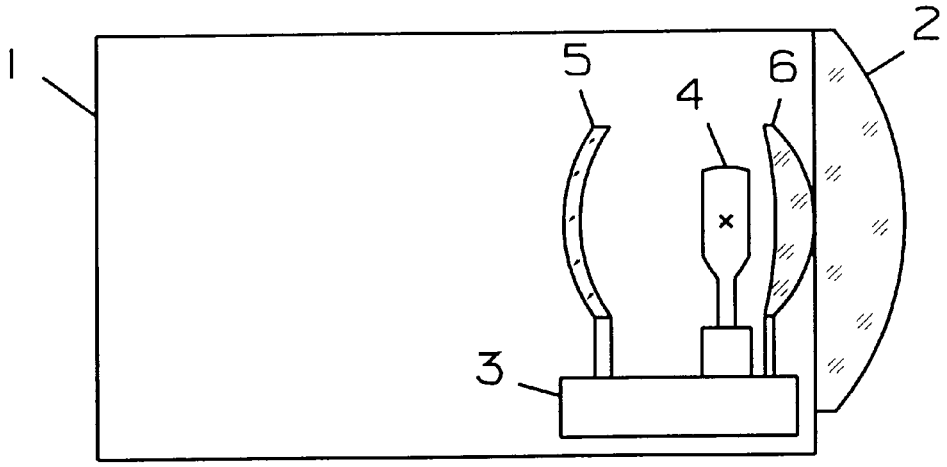
Figure 3B:
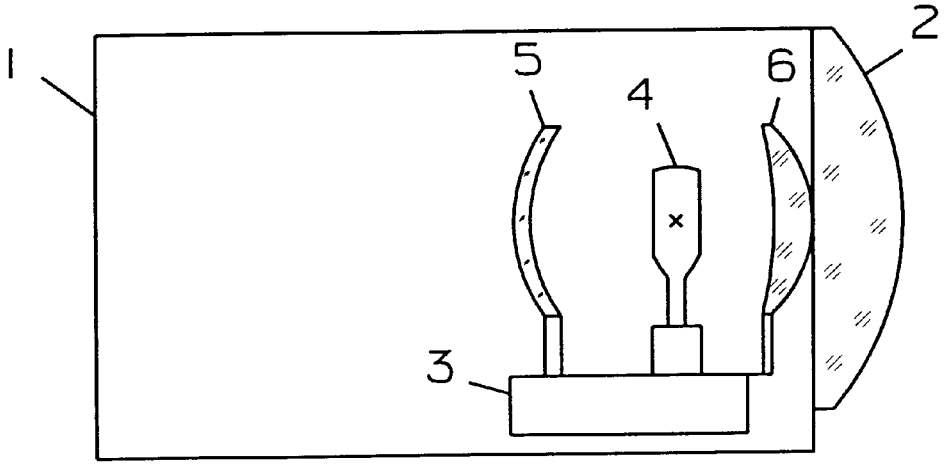
Figure 3C:
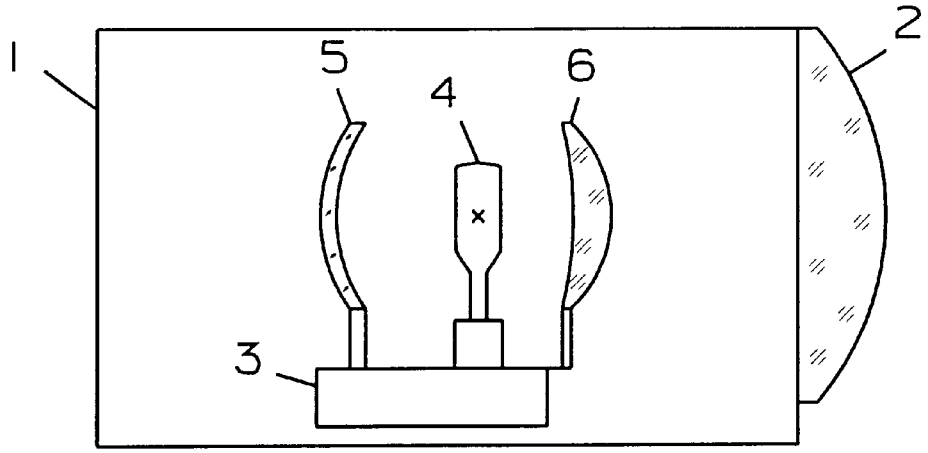
Figure 3D:
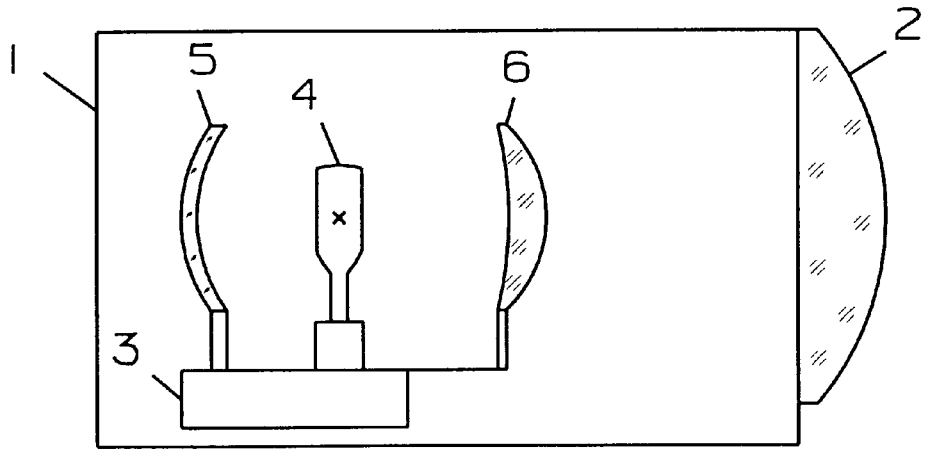
Figure 3E:
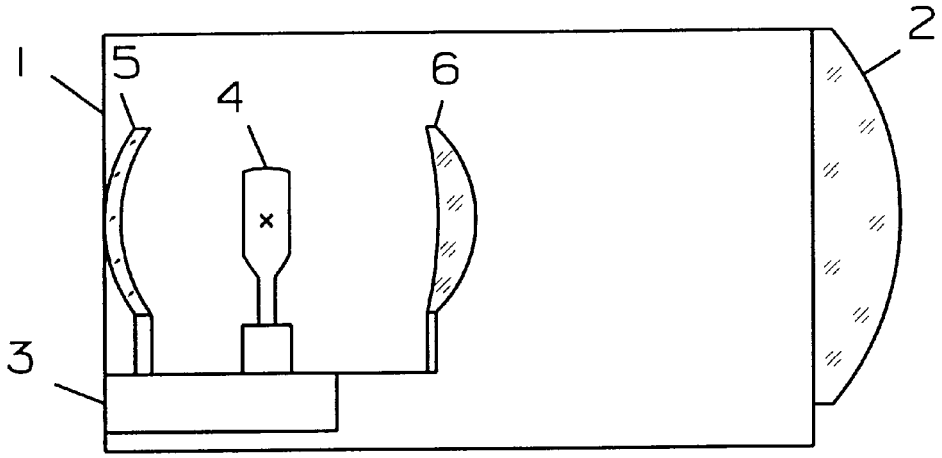
Figure 3F:
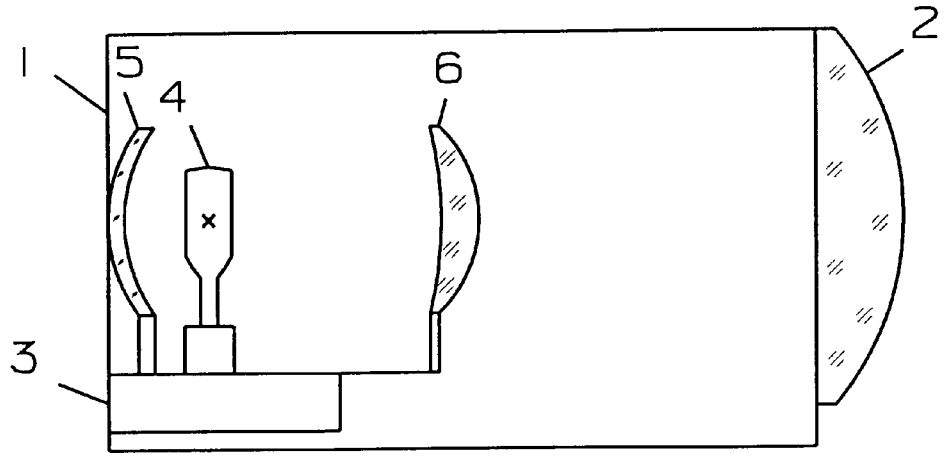

In addition to a mechanical slide system, which makes possible the above-described movements, there are other embodiments of slide systems of the spotlight of this invention which bring about slightly modified movements. Thus, for example, in one embodiment of the spotlight of this invention the second focusing lens 6 during a rear portion of the on going movement of the slide 3 from the first focusing lens 2 does not abruptly stop, rather, during a constant relative speed between the light source 4 and the first focusing lens 2, a relative speed between the second focusing lens 6 and the first focusing lens 2 is continuously decreased until the second focusing lens 6 finally stops while the reflector 5 and the light source 4, while maintaining their relative spacing from one another, move away from the first focusing lens 2 (FIGS. 3*a*–3*e*). Finally, the reflector reaches the outward-most position depicted in FIG. 3*e* and now the light source 4 continues to move away from the first focusing lens 2 until the light source 4 finally also has reached its outward-most position (FIG. 3*f*). When this movement course is reversed, the light source 4 first moves toward the second focusing lens 6 while the reflector 5 and the second focusing lens 6 remain stationary. As soon as a predetermined spacing between the light source 4 and the reflector 5 has been reached, both of these move toward the second focusing lens 6 at the same speed. Finally, the second focusing lens 6 is put in motion toward the first focusing lens 2 with the speed of this movement continuing to increase until finally the second focusing lens 6, the light source 4, and the reflector 5 maintain there relative spacing from one another while moving toward the first focusing lens 2. Further course of the movement is then finally identical with the movement course of the above described embodiments for the front portion of the slide movement, that is, for movement of the slide near the first focusing lens 2. Also a slide system which makes possible the movement course described here could be realized by one of ordinary skill in the art in many different ways without problems.

In FIGS. 1*a* through 3*f*, the reflector 5 is constantly depicted as a relatively flat reflector and the light source 4 is depicted as a vertically standing incandescent lamp. It is, however, possible to employ a deep reflector and/or horizontal lamp. A particularly good light intensity increasing effect in a small illumination angle range results if a lying lamp extends into a deep reflector.

In place of the incandescent filament bulb specified in the above embodiment, the light source 4 may be a halogen bulb or a filament-less discharge lamp with a light spot between two electrodes. However, the light source 4 should be kept as small as possible in any case.

A spotlight with an adjustable angle of radiation of this invention has all the advantages of the spotlight disclosed in U.S. Pat. No. 4,823,243, but exhibits increased variability in its angle of radiation and illuminance. Despite having an increased area of focus, spotlights of this invention can be kept small in size.

In a preferred embodiment of the spotlight of this invention, the optical unit is designed so that when the optical unit is moved away from the first focusing lens, the distance between the light source and the reflector remains essentially constant until the reflector reaches an extreme distance with respect to the first focusing lens, determined by dimensions of the spotlight, where the reflector stops moving, and while the reflector remains stationary at its extreme distance with respect to the first focusing lens, the light source can be still moved further along the predetermined path in the direction of the reflector; when this above-described movement is reversed, the light source is first moved along the predetermined path in the direction of the first focusing lens, while the reflector remains stationary, and after a predetermined path is completed by the light source, the reflector is moved as well, so that the distance between the light source and the reflector remains essentially constant.

In this embodiment of the spotlight of this invention, the area of focus is greatly increased, particularly in a direction of small angles. In addition, because of the described reduction in the distance between the light source and the reflector, loss during focusing in the narrow-angle area of reflection is reduced significantly. Change in illuminance in this narrow-angle area of reflection is disproportionately large, with respect to a change of the angle of radiation, which results in a particularly sharp increase in illuminance variability in comparison to spotlights of the prior art.

In a further embodiment of the spotlight of this invention, the optical unit is designed so that during a movement of the optical unit along the optical axis the distance between the light source and the reflector changes at least during a portion of the movement.

It is particularly advantageous for the optical unit to be designed so that a distance between the light source and the reflector is reduced continuously as the optical unit moves away from the first focusing lens, and increases continuously as the optical unit moves toward the first focusing lens.

While the invention has been particularly shown and described with reference to a preferred embodiment, it will be understood by those skilled in the art that various changes in form and detail may be made therein without departing from the spirit and scope of the invention.

The invention claimed is:

1. A spotlight for producing a light beam with an adjustable angle of radiation, having:

a light source (4), a reflector (5) associated with the light source (4), a first focusing lens (2) positioned in a light-beam path of said light beam produced by the light source-reflector combination (4, 5), and a second focusing lens (6) placed in the light-beam path between the light source (4) and the first focusing lens (2), wherein the reflector (5), the light source (4), and the second focusing lens (6) are mounted as an optical unit that is movable along an optical axis of the spotlight relative to the first focusing lens (2), a distance between the light source (4) and the second focusing lens (6) is adjustable inside the optical unit, and a distance between the light source (4) and the reflector (5) is adjustable.

2. A spotlight as in claim 1, wherein the optical unit includes means for supporting the reflector, the light source and the second focusing lens so that: when the optical unit is moved away from the first focusing lens (2), a distance between the light source (4) and the reflector (5) remains essentially constant until the reflector (5) reaches an extreme distance away from the first focusing lens where the reflector stops moving, but the light source (4) can continue to move away from the first focusing lens toward the reflector (5) to reduce the distance between the light source and the reflector; and when the movement described above is reversed, the light source (4) is first moved toward the first focusing lens (2), while the reflector (5) remains stationary, until the reflector (5) is eventually moved with the light source so that a distance between the light source (4) and the reflector (5) remains essentially constant.

3. A spotlight as in claim 1, wherein the optical unit is structured so that during a movement of the optical unit along the optical axis, the distance between the light source (4) and the reflector (5) changes at least during a portion of the movement.

4. A spotlight as in claim 3, wherein the optical unit is structured so that the distance between the light source (4) and the reflector (5) is continuously reduced as the optical unit moves away from the first focusing lens (2), and is continuously increased as the optical unit moves toward the first focusing lens (2).

* * * * *